United States Patent [19]

Mays et al.

[11] Patent Number: 4,657,804

[45] Date of Patent: Apr. 14, 1987

[54] FUSIBLE FIBER/MICROFINE FIBER LAMINATE

[75] Inventors: Alfred T. Mays; Ching-Yun M. Yang, both of East Windsor, N.J.

[73] Assignee: Chicopee, New Brunswick, N.J.

[21] Appl. No.: 765,633

[22] Filed: Aug. 15, 1985

[51] Int. Cl.[4] ..... A61B 19/02; B32B 5/26; B65B 55/02; B65D 5/62

[52] U.S. Cl. ..... 428/212; 156/182; 156/244.24; 156/244.27; 156/278; 156/280; 156/308.2; 206/438; 206/439; 206/524.2; 206/524.6; 206/811; 220/417; 220/449; 220/453; 220/457; 220/DIG. 11; 229/68 R; 229/75; 229/3.1; 229/3.5; 428/35; 428/76; 428/286; 428/287; 428/288; 428/290; 428/296; 428/311.1; 428/311.5; 428/315.9; 428/317.7; 428/317.3; 428/317.5

[58] Field of Search ..... 156/182, 244.24, 244.27, 156/278, 280, 308.2; 206/438, 439, 524.2, 524.6, 811; 220/417, 449, 453, 457, DIG. 11; 229/68 R, 75, 3.1, 3.5; 428/35, 76, 212, 286, 287, 288, 290, 296, 311.1, 311.5, 315.9, 317.3, 317.5, 317.7

[56] References Cited

U.S. PATENT DOCUMENTS 4,508,113 4/1985 Malaney ..... 428/296

*Primary Examiner*—James C. Cannon

[57] ABSTRACT

A water-impervious, smooth-surfaced, gas-permeable, bacterial barrier, repellent treated, laminated material is described. A preferred embodiment comprises a ply of hydrophobic microfine fibers fuse bonded to a layer of conjugate fibers having a low melting sheath and a high melting core. The ply of hydrophobic microfine fibers is low melting. The sheaths of the conjugate fibers have been fuse bonded to the hydrophobic microfine fibers at a temperature below the melt temperature of the cores of the conjugate fibers so that the cores retain their initial fiber-like integrity. The laminated material is preferably impregnated with both a repellent binder and a repellent finish to secure good repellency, lamination and peelability.

29 Claims, No Drawings

FUSIBLE FIBER/MICROFINE FIBER LAMINATE

This invention relates to fusible fiber/microfine fiber laminated materials and, more particularly, to sterile packaging barriers which are impermeable to the passage of microorganisms and fluids, but which are gas-permeable, smooth surfaced and, thus highly printable.

BACKGROUND OF THE INVENTION

Articles intended for medical use, such as intravenous catheters, for instance, are conventionally stored in containers such as formed polymer blisters, which containers are covered with a barrier material (or lid) which permits the infusion of a sterilization gas, such as steam or ethylene oxide, but which nevertheless provides a barrier substrate to aqueous fluid. A flash-spun polyolefin produced by DuPont and known by the trademark Tyvek, is currently in extensive use as such lid-stock material for sterile packaging applications. Tyvek offers little resistance to the temperatures encountered in steam sterilization and it is also rather difficult to print due to its uneven surface and strongly hydrophobic nature. Although Tyvek is strong and has good tear properties, it possesses a rather low-level permeability to gases.

Treated paper may also be used as a sterile packaging barrier and has the advantage of possessing a very fine pore size. However, such treated paper tears easily, has a lack of wet strength and does not possess adequate peel strength. The present invention provides a strong laminated fabric that provides excellent barrier properties as well as highly printable surfaces. In addition, the present composite, nonwoven fabric demonstrates improved resistance to steam sterilization. Further, the present fabric can be effectively sterilized at lower pressures and in a shorter time than Tyvek or paper.

The laminate of the present invention preferably comprises at least one ply of hydrophobic microfine fibers, fuse bonded to a layer of conjugate fibers by means of smooth calendering. The surface of the conjugate fiber fabric is highly printable due to its extreme uniformity. The microfiber side of the laminate provides excellent barrier properties to aqueous fluids and is susceptible to graphic printing and, in addition, provides a surface which is compatible with existing seal-coat systems that are required for heat sealing of this material to a formed polymer blister. However, the seal-coat printing on the conjugate fiber side is preferred. Conventionally, the seal-coat system consists of a heat seal resin (such as ethylene/vinyl acetate hot melt) which is printed on the fabric which is to be sealed to a polymer blister. The heat seal resin acts as a bonding medium between the barrier material and the polymer blister. Preferably, the seal-coat is printed onto the conjugate material in discrete dots so as not to occlude the entire fabric.

The laminate of the present invention comprises at least one layer of microfine fibers which are compatible with and fuse bonded to at least one layer of conjugate fibers, and, thus, the laminate is extremely resistant to delamination. Furthermore, in view of the fact that the laminate of the present invention is produced by calendering between heated rollers with direct heat being applied to both surfaces of the fabric, this brings about a very regular surface and increases the strength and abrasion resistance properties of the composite.

The laminated material of the present invention is primarily intended as a sterile packaging barrier, the primary use being for lid-stocks for medical packaging application. However, it could also be adapted for use as a surgical drape and, in addition, the present laminate may be used in the central supply room of a hospital for wrapping surgical instruments prior to sterilization with steam or ethylene oxide. Furthermore, the laminate of the present invention may be utilized in the form of a sealed envelope, thus dispensing entirely with any polymer blister.

Certain barrier materials are known which consist of non-woven layers of heat fusible fibers fused to nonwoven fabrics comprising multiple plies of microfine fibers. However, in producing this type of fabric, the heat fusible fibers are fused so that the integrity of the fibers is destroyed. The present invention provides at least one hydrophobic microfine fiber layer fuse bonded to at least one layer of conjugate fibers having a low-melting sheath and a high-melting core. The sheaths of the conjugate fibers are fuse bonded to the hydrophobic microfine fiber layer at a temperature below the melt temperature of the cores of the conjugate fibers so that the cores retain their initial fiber-like integrity. Furthermore, in view of the fact that the hydrophobic microfine fiber layer is compatible with the conjugate fiber sheath, excellent fusion takes place when the two layers are bonded together by smooth calendering or other heat means.

The microfine fibers utilized in the present invention are preferably produced by melt blowing. However, microfine fibers can also be produced, for instance, by a centrifugal spinning operation (see Vinicki's U.S. Pat. No. 3,388,194).

THE PRIOR ART

The Kitson et al. U.S. Pat. No. 4,196,245 describes a composite nonwoven fabric which comprises at least two hydrophobic plies of microfine fibers and at least one nonwoven cover ply. There is no disclosure in Kitson et al. concerning the use of conjugate fibers for the nonwoven cover ply. Furthermore, the Kitson et al. fabric is cloth-like and is, thus, not easily printable.

Floden, in U.S. Pat. No. 3,837,995, describes a web containing one or more layers of melt blown fibers and one or more layers of larger diameter natural fibers. No conjugate fibers are disclosed.

Prentice, in U.S. Pat. Nos. 3,795,571 and 3,715,251, describes a nonwoven sheet of melt blow thermoplastic fibers comprising a plurality of laminated nonwoven sheets of melt blown thermoplastic fibers. No cover ply of conjugate fibers is disclosed.

Marra, in U.S. Pat. No. 4,302,495, discloses a nonwoven fabric-like material comprising at least one integrated mat of generally discontinuous thermoplastic polymeric microfibers and at least one layer of nonwoven continuous, linearly oriented thermoplastic netting having at least two sets of strands wherein each set of strands crosses another set of strands at a fixed angle and having uniformly-sized openings, said netting and said integrated mat bonded together by heat and pressure to form a multilayer, nonwoven fabric of substantially uniform thickness. No smoothly calendered layer of conjugate fibers is disclosed.

Brock et al., in U.S. Pat. No. 4,041,203, discloses a nonwoven fabric-like material comprising a web of substantially continuous and randomly deposited, molecularly oriented filaments of a thermoplastic polymer and an integrated mat of generally discontinuous, thermoplastic polymeric microfibers; said web and mat being united together at intermittent, discrete bond regions formed by the application of heat and pressure to thereby provide a unitary structure having textile-like appearance and drape characteristics. No smooth calendered layer of conjugate fibers is disclosed.

Schultheiss et al., in U.S. Pat. No. 4,180,611, discloses a nonwoven fabric having a smooth surface for use as support material for semipermeable membranes comprising a support mat into which at least one surface thereof, an open structured, continuous covering layer of fine thermoplastic particles is calendered. There is no disclosure of the laminate of the present invention.

Wahlquist et al., in U.S. Pat. No. 4,379,192, discloses an absorbent impervious barrier fabric in the form of a laminate that has a fibrous section including a mat of polymeric melt blown microfibers and an impervious polymeric film adjacent to said mat. The fibrous section and the film are united in compacted bond regions formed by the application of heat and pressure.

Thompson, in U.S. Pat. No. 3,916,447, discloses a protective covering having at least one layer of synthetic polymeric microfibers bonded to at least one other layer of cellulosic fibers.

Newman in U.S. Pat. No. 3,973,067 discloses nonwoven fabrics produced by applying to a dry-laid fibrous web, an aqueous dispersion of ultra-short fibers, said ultra-short fibers being coated with a polymeric binder and being suspended in an aqueous phase which is substantially free of binder.

Krueger, in U.S. Pat. No. 4,042,740, discloses webs of blown microfibers having a network of compacted, high density regions and pillowed, low-density regions which are reinforced by a mesh of filaments used to collect the web.

Ikeda et al., in U.S. Pat. No. 4,146,663, discloses a composite fabric useful as a substratum for artifical leather, comprising a woven or knitted fabric and at least one nonwoven fabric firmly bonded to the woven or knitted fabric.

Bornslaeger, in U.S. Pat. No. 4,374,888, discloses a laminate of nonwoven fabric suitable for the manufacture of tents, tarpaulins and the like. The laminate includes an outer, spunbonded layer, an inner microporous, melt blown layer and on the unexposed surface, another nonwoven layer. No cover ply of conjugate fibers is disclosed.

Nakamae et al., in U.S. Pat. No. 4,426,421 disclose a multilayer composite sheet useful as a substrate for artificial leather comprising at least three fibrous layers, namely, a superficial layer consisting of a spun-laid web, an intermediate layer consisting of a web of staple fibers and a base layer consisting of woven or knitted fabric. The three fibrous layers are superimposed on each other and combined together in such a manner that a portion of the fibers in each layer penetrates into the adjacent layers and becomes entangled three-dimensionally with the fibers in the adjacent layers.

Malaney, in U.S. Pat. No. 4,508,113, discloses microfine fiber laminated materials, specially useful for absorbent disposable drapes which are impermeable to the passage of microorganisms and fluids. Said laminated material comprises at least one layer of conjugate fibers bonded to a first ply of microfine fibers as well as at least one additional ply of microfine fibers, the first ply of microfine fibers being thermoplastic and possessing a lower melt temperature than the additional ply of microfine fibers. The present invention differs therefrom in being smooth calendered, repellent treated, and requiring only one ply of microfine fibers although additional layers thereof may be present. This smoother calendering improves the printability and abrasion resistance as well as the strength properties of the laminate of the present invention. The repellent treatment of the present invention improves liquid resistance and peelability without adversely affecting printability. The term "repellent" as used herein, is intended to refer to a repellent binder, a repellent finish or a mixture of both.

SUMMARY OF THE INVENTION

In accordance with the present invention, there is provided a water-impervious, smooth-surfaced, gas-permeable, bacterial barrier, repellent treated, laminated material comprising at least one layer of conjugate fibers, said layer of conjugate fibers having a first face and an opposite face, said conjugate fibers being composed of a lower melting component and a higher melting component, wherein a substantial proportion of the surfaces of said conjugate fibers comprises said lower melting component, said lower melting component of said conjugate fibers which lie on said first face being fuse bonded to at least one hydrophobic ply of thermoplastic microfine fibers having a fiber diameter of up to 50 microns, said lower melting component of said conjugate fibers having been fuse bonded at a temperature below the melt temperature of said higher melting component of said conjugate fibers so that the latter component retains its initial fiber-like integrity, said material having been treated with a water repellent. Preferably, the lower melting component of the conjugate fibers is compatible with the hydrophobic microfine fibers, the laminated material being highly compacted or fully contacted and also resistant to delamination and resistant to steam sterilization. As pointed out above, the repellent utilized in treating the laminated material of the present invention comprises a repellent binder, a repellent finish or preferably a mixture of both.

The non-wettable material of the present invention possesses an increased hydrostatic head, including an increased fabric strength and dimensional stability, surface abrasion resistance and tolerance to peeling as compared to the untreated material.

In accordance with an embodiment of the present invention, there is provided a water-impervious, smooth-surfaced, gas-permeable, bacterial barrier, repellent treated, laminated material comprising at least one inner hydrophobic microfine fiber ply sandwiched between two layers of conjugate fibers, each of said layers of conjugate fibers having a first face and an opposite face, said conjugate fibers being composed of a lower melting component and a higher melting component, wherein a substantial proportion of the surfaces of said fibers comprises said lower melting component, said hydrophobic microfine fibers having a fiber diameter of up to 50 microns, said lower melting components of both layers of said conjugate fibers which lie on said first faces having been fuse bonded to opposite sides of said hydrophobic microfine fiber ply at a temperature below the melt temperature of said higher melting component of said conjugate fibers, so that the latter component retains its initial fiber-like integrity, said material having been treated with a water repellent.

In accordance with a further embodiment of the present invention, the layer of conjugate fibers may be blended with non-conjugate fusible fibers, with the proviso that the first face of the layer of conjugate fibers contains a plurality of conjugate fibers in the blend. The specific nature and melt temperatures of the non-conjugate portions of the blend are not critical since the conjugate-rich material in the first face of the layer which is fused to the hydrophobic microfine fiber ply insures good bonding features.

The present invention also includes a sterile package comprising a polymer blister sealed with a laminated material of the invention. In addition, the present invention includes a sterile package comprising a sealed envelope consisting of the laminated material of the invention.

The present invention also includes a process for preparing a water-impervious, smooth-surfaced, gas-permeable, bacterial barrier, repellent treated, laminated material comprising at least one layer of conjugate fibers, said layer of conjugate fibers having a first face and an opposite face, said conjugate fibers being composed of a low melting component and a higher melting component, wherein a substantial proportion of the surfaces of said conjugate fibers comprises said lower melting component, said lower melting component of said conjugate fibers which lie on said first face being fuse bonded to at least one hydrophobic ply of microfine fibers having a fiber diameter of up to 50 microns, said lower melting component of said conjugate fibers having been fuse bonded at a temperature below the melt temperature of said higher melting component of said conjugate fibers so that the latter component retains its initial fiber-like integrity, said process comprising forming an assembly of said ply of hydrophobic microfine fibers and at least one layer of said conjugate fibers placed adjacent to said ply of said hydrophobic microfine fibers; subjecting said assembly to smooth calendering at a temperature sufficient to fuse said lower melting component of said conjugate fibers which lie on said first face as well as the ply of the hydrophobic microfine fibers without fusing the higher melting component of said conjugate fibers, direct heat being applied to both outer surfaces of said assembly so that said surfaces are regular and the resultant material has good strength properties; cooling said assemply to resolidify said lower melting component of the conjugate fibers as well as said ply of said hydrophobic microfine fibers, whereby said conjugate fibers are firmly bonded to said hydrophobic microfine fiber structure without impairing the integrity of said higher melting component of said fibers, and treating said resultant laminated, material with a repellent, or utilizing a layer of conjugate fibers which has been pretreated with a repellent before forming said assembly of said ply of microfine fibers and said layer of conjugate fibers.

In accordance with an embodiment of the invention, there is provided a process for preparing a water-impervious, smooth-surfaced, gas-permeable, bacterial barrier, laminated material comprising at least one inner ply of hydrophobic microfine fibers sandwiched between two layers of conjugate fibers, each of said layers of conjugate fibers having a first face and an opposite face, said conjugate fibers being composed of a lower melting component and a higher melting component, wherein a substantial proportion of the surfaces of said fibers comprises said lower melting component, said ply of hydrophobic microfine fibers having a fiber diameter of up to 50 microns, said lower melting components of both layers of said conjugate fibers which lie on said first faces having been fuse bonded to said ply of hydrophobic microfine fibers at a temperature below the melt temperature of said higher melting component of said conjugate fibers, so that the latter component retains its initial fiber-like integrity, said material being resistant to steam sterilization, said process comprising forming an assembly of said ply of hydrophobic microfine fibers sandwiched between two layers of said conjugate fibers; subjecting said assembly to smooth calendering at a temperature sufficient to fuse said lower melting components of said conjugate fibers which lie on said first faces in both of said layers thereof as well as said ply of said hydrophobic microfine fibers without fusing the higher melting components of said conjugate fibers, direct heat being applied to both outer surfaces of said assembly so that said surfaces are regular and the resultant material has good strength properties; cooling said assembly to resolidify said lower melting components of the fibers as well as said ply of hydrophobic microfine fibers, whereby said fibers are firmly bonded to said hydrophobic microfine fibers without impairing the integrity of said higher melting component of said fibers and treating said resultant laminated material with a repellent, or utilizing layers of conjugate fibers which have been pretreated with a repellent before forming said assembly of said ply of microfine fibers and said two layers of conjugate fibers.

DETAILED DESCRIPTION OF THE INVENTION

In accordance with the present invention, the hydrophobic microfine fiber ply may consist of any suitable thermoplastic polymer such as ethylene/propylene copolymer, polyester copolymer, low-density polyethylene, ethylene/vinyl acetate copolymer, polyethylene, polypropylene, chlorinated polyethylene, polyvinyl chloride, polyamide, high density polyethylene or linear low-density polyethylene.

Although continuous filaments of conjugate fibers may be employed, nevertheless the preferred conjugate fibers are textile length, that is, they are fibers having lengths of from one-quarter inch and preferably from one-half inch up to about three inches or more in length. Such conjugate fibers can be bi-component fibers such as the sheath/core of side-by-side bi-component fibers, wherein there is a lower melting component and a higher melting component, with a significant proportion and preferably a major proportion of the surface of the fibers being the lower melting component. Preferably, the lower melting component is a polyolefin, and most preferably, a polyethylene. In many cases the sheath/core, bi-component fibers are preferred, because they exhibit a better bonding efficiency than the side-by-side, bi-component fibers, and because in some cases the side-by-side, bi-component fibers may exhibit an excessive tendency to curl, crimp or shrink during the heat bonding step. Both concentric and eccentric sheath/core bi-component fibers can be used.

The nonwoven conjugate fiber layers of the present invention can have basis weights from about 0.25 to about 3.0 ounces per square yard. In the thermal bonding step, the lower melting component of the conjugate fiber is at least partially fused so that where the fused surface touches another conjugate fiber, welding or fusing together of the two fibers will occur. It is important in order to achieve the objects of the invention that the conjugate fibers remain fibers, i.e., that the higher melting component of the conjugate fibers not melt or shrink significantly and thereby become beads or the like. The layer of conjugate fibers may be oriented or random. However, oriented webs offer greater resistance to machine direction elongation, which is of benefit.

In accordance with a preferred embodiment of the invention, the hydrophobic microfine fiber ply comprises polypropylene or polyethylene. A preferred conjugate fiber comprises a polyethylene/polyester, sheath/core, bi-component fiber. Another preferred conjugate fiber comprises a polypropylene polyester, sheath/core, bicomponent fiber. Melt blowing is the preferred method of preparing the hydrophobic microfine fiber ply.

The preferred laminated material of the present invention is prepared by calendering between smooth heated rolls, direct heat having been applied to both outer surfaces of the material so that said surfaces are regular and the material has good strength properties. If the conjugate fibers have been initially oriented, the conjugate fiber webs will offer greater resistance to machine direction elongation.

The laminate of the present invention may be initially formed by passing a pre-bonded layer of conjugate fibers beneath a melt blown die which deposits said ply of microfine fibers on the surface of said layer of conjugate fibers.

Alternatively, the layer of conjugate fibers may be initially unbonded, and the ply of microfine fibers may be formed separately before being assembled with said layer of conjugate fibers.

Materials suitable for sterile-wraps should be able to protect the contents from airborne and waterborne bacteria contamination. These materials should also contain micropores to allow the contents to be sterilized by ethylene oxide and steam.

In accordance with the present invention, the laminates discussed above are treated with a water repellent to reduce fabric surface energy and voids between fibers. The repellent can be added by the "dip" and "nip" method before or after calendering. The "dip" and "nip" method is carried out by immersing the fabric in a bath of suitable repellent followed by passing the fabric through the nip between steel and rubber rollers to press off excess add-on. The water repellent may consist of a water repellent finish, a water repellent binder or a mixture of both. The water repellent finish, which is primarily utilized for its repellent effect, is far more repellent than the binder which, as the name implies, is utilized primarily for binding the fibers of the fabric and fabric plies together and to fill in the voids between the fibers.

The water repellent finish should comprise at least about 0.05% by weight of the untreated material. Further, the repellent binder should comprise at least about 1% (and preferably between about 1% and 25%) by weight of the unimpregnated material.

Examples of suitable water repellent finishes are wax emulsions, polyurethane emulsions, silicones and fluoro chemicals. Examples of suitable repellent finishes which may be utilized in accordance with the present invention are Aerotex 96B, sold by American Cyanamid (which comprises a polyurethane emulsion); Phobotex, sold by Ciba (consisting of a wax emulsion); FC 838 and FC 826, sold by Minnesota Mining and Manufacturing (consisting of a fluorochemical); and Milease F-14 and Milease F-31X, sold by ICI, (consisting of a fluorochemical).

The above repellent finishes, which improve the repellency of the laminate, are applied in the range of between 0.1 and 0.6% by weight, based on the weight of the untreated fabric. A preferred repellent finish, in accordance with the present invention is Milease F-14, a fluorochemical. Where the laminate of the present invention is to be utilized as a lid for a polymer blister, it is important that it should be able to be easily peeled from the blister, without delamination of fiberization of the laminate, and the repellent finish enables the laminate to be more easily peeled from the blister. However, no more than 5% by weight of the repellent finish should be used, since larger amounts tend to adversely affect the graphic printability on the outer surfaces of the laminate.

When the conjugate fiber side of the laminate is printed with a seal-coat system required for heat sealing the laminate to a formed polymer blister, then after the laminate is peeled from the blister there will be a tendency for fibers to be pulled off laminates. This problem is prevented, by providing the laminate with additional binder.

Suitable repellent binders which may be used in accordance with the present invention are: polybutyl acrylate, styrene-acrylic copolymer, acrylic vinyl chloride copolymer, ethylene-acrylic acid copolymer (preferably about 96% ethylene and about 4% acrylic acid), ethylene-vinyl acetate copolymer, ethylene-vinyl chloride copolymer, acrylic copolymer latex, styrene-butadiene latex, and vinyl chloride latex. Suitable repellent binders which may be utilized are Geon 580X83 and Geon 580X119, sold by Goodrich (consisting of vinylchloride latex); Emulsion E1497, and Emulsion E1847, sold by Rohm & Haas (consisting of an acrylic emulsion); and Rhoplex NW-1285, sold by Rohm & Haas (consisting of an acrylic emulsion); Airflex 120 and Airflex EVLC 453, sold by Air Products (consisting of ethylene vinyl chloride emulsions); Nacrylic 78-3990, sold by National Starch (consisting of an acrylic emulsion) and Primacor, sold by Dow Chemical (consisting of an ethylene/acrylic acid copolymer).

The methods for preparing the laminates of the present invention, are disclosed, in a general manner, in the Malaney U.S. Pat. No. 4,508,113, which is incorporated herein by reference.

In accordance with one method of the present invention, there is prepared a laminated material comprising a core of microfine fibers with facings of heat-fusible conjugate fibers on both faces of the core. In accordance with said method, a web of heat-fusible conjugate fibers is laid down (as from a card) onto an endless belt. Thereafter, a microfine fiber web which may be lightly prebonded, is then laid on top of the first web of conjugate fibers. Thereafter, the double layer web is passed under another station wherein a second web of heat-fusible conjugate fibers is laid on top (as from a card) so as to form a sandwich structure. Although the two conjugate fiber webs are preferably prepared from the cards, nevertheless, air-laid webs may also be used. Although the conjugate fiber webs are preferably fuse bonded in a subsequent step, said conjugate fiber webs may have been initially fuse bonded, in a prior step, before they are laid on either side of the microfine fiber web. The resulting triple layer web is then passed through a fusion unit to fuse the lower melting component of the conjugate fibers while maintaining the integrity of the higher melting component of these fibers as fibers, and to fuse the core layer of microfine fibers so as to securely bond the two conjugate fiber webs on either side of the microfine fiber web. When the multiple layer web emerges from the fusion unit, it cools to thereby form the laminate utilized in accordance with the present invention. After the triple layer laminate has cooled, the fused lower melting component of the conjugate fibers, solidifies and bonds then form where the surfaces touch other fibers. In the instance wherein the repellent is added after the laminate is prepared, any suitable means of fushion bonding may be used in the fusion unit such as by means of a conventional heated calender or by passing the assembly through an oven while the assembly is held between two porous belts under light pressure.

In the instance wherein the core of microfine fibers consist of polypropylene and the conjugate fibers comprise a polyethylene/polyethyleneterephthalate sheath-/core bi-component fiber, the web temperature maintained in the fusion unit (whether the composite is belt or calender bonded) is preferably in the range of 135° C. to 145° C.

The exact temperatures employed in the fusion unit will depend upon the nature of the conjugate fiber used and the dwell time employed in the fusion unit. For instance, when the lower melting component of the conjugate fiber is polyethylene, the bonding temperature is usually from about 110° C. to about 150° C., and when the lower melting component is polyproplylene, the bonding temperature is usually from about 150° C. to about 170° C. Dwell times in the fusion unit will usually vary from about 0.01 seconds to about 15 seconds. In a modification of the above process, two layers of microfine fibers are used in contact with one another and only one layer of conjugated fibers is laminated to one side only of the microfine fiber layers. Otherwise the bonding procedure is the same as described above. Specific conditions under which the thermal bonding is achieved are illustrated in the examples below. The temperatures referred to are the temperatures to which the fibers are heated in order to achieve bonding. In order to achieve high speed operations, much higher temperatures with short exposure times can be used.

The examples below illustrate various aspects of the invention.

EXAMPLE I

A web of through-air bonded conjugate fibers (1.5 ounces per square yard) prepared by card webbing was fused into a fabrc in an oven. The conjugate fibers consist of high density polyethylene/polyethyleneterephthalate sheath/core bi-component fibers, the core being concentric. The high density polyethylene in the conjugate fibers has a softening range of 110°-125° C. and a melting point of about 132° C. The polyethyleneterephthalate core of the conjugate fibers has a softening range of 240°-260° C. and a melting point of about 265° C. The polyethylene comprises 50% of the conjugate fiber. Thereafter, a two ply web of polypropylene melt blown microfine fibers was laid on top of the conjugate fabric. The thickness of each melt blown web was 7 mil and each weighed 1 oz/yd$^2$. The two ply melt blown web, after having been laid upon the conjugate fabric formed a triple layer web. The resultant triple layer web was bonded by a through-air belt bonder at 140° to 165° C. and then calendered on a smooth Ramisch calender at 130° C. This resulted in a well-bonded fabric. Thereafter the bonded triple layer fabric was treated by the "dip" and "nip" method with a mixture consisting of Primacor (a copolymer of ethylene and acrylic acid) sold by Dow Chemical Company, in order to impregnate the fabric with from 5 to 10% by weight, based on the untreated weight of the fabric, of the repellent binder, and with 0.02% by weight, based on the untreated weight of the fabric, of a fluorochemical repellent finish sold by ICI and known by the tradename Milease F-14.

The resultant triple layer fabric was very porous, but the hydrostatic head after repellent treatment was better than 100 cm. The hydrostatic head test, carried out in accordance with the basic hydrostatic pressure test AATCC TM #127-1977, involves subjecting a specimen to increasing water pressure while the surface is observed for leakage. The air permeability of the triple layer fabric according to the Gurley test was 4 seconds. This compares to a Gurley test reading for Tyvek of 23 seconds, and a Gurley test reading for paper of between 75 and 300 seconds. The Gurley test measures the amount of time required, under specified, conditions, for 100 cc's of air to permeate through a test sample.

EXAMPLE 2

Example 1 is repeated with the following modifications: One ply of polypropylene melt blown fibers (1.0 oz/yd$^2$) extruded from two separate dies, is laminated to one ply, only of the through-air bonded conjugate fabric (1.5 oz/yd$^2$). Otherwise, the bonding procedure is the same as that carried out in connection with Example 1 and, in addition, the laminate is treated with Primacor repellent binder and Milease F-14 repellent finish in a ratio of 30:1.

In each of the above examples, the thickness of each polypropylene melt blown web was approximately 5-10 mil and the thickness of the conjugate fabric was approximately 4-15 mil.

The product of Example 1 was found to possess good tensile strength and dimensional stability so that the laminate is suitable as a sterile packaging barrier, substantially impermeable to the passage of microorganisms in fluid but which is gas-permeable, smooth surfaced and highly printable.

TEST FOR BACTERIAL BARRIER PROPERTIES

The laminate prepared in accordance with Example 1 was subjected to air permeability tests in order to determine its bacterial barrier properties under positive atmospheric conditions. The laminate was subjected to the standard test procedure described in HIMA Test 78-4.11 No. 5 method June 1979 which is the protocol for determining the microbial barrier characteristics of packaging materials. This procedure is one which may be performed on any air permeable material to be used in packaging medical products. The principles of the test are as follows: Spores are introduced onto the surface of the test material under positive pressure. Spores that penetrate the sample are collected on a 0.45 micron filter, cultivated and counted. Inoculation level is determined by performing the tests without a sample in place and then recovering the spores. Percent efficiency of filtration can then be determined. This test is used to determine the relative filtering ability of packaging materials.

The following test results set forth the percentage penetration of spores through the product of Example 1. The spores utilized in the tests were B-stearothermophilus which were added to a nebulizer. Thereafter, the spores were introduced onto the surface of the test material under positive pressure.

TABLE 1

| Example 1 | Sample % Penetration | Challenge Concentration Colony forming units (CFUs) |
|---|---|---|
| Test 1 | 0.05 | $10^5$ |
| Test 2 | 0.18 | $10^5$ |

It will be noted from the above Table 1 that at a spore challenge concentration of $10^5$ spores per mil of water the sample percent penetration of the product of Example 1 was extremely low (0.05% for one test and 0.18% for another). This sample percent penetration is thus quite acceptable since the test was carried out under severe conditions.

What is claimed is:

1. A water-impervious, smooth-surfaced, gas-permeable, bacterial barrier, laminated material comprising at least one layer of conjugate fibers, said layer of conjugate fibers having a first face and an opposite face, said conjugate fibers being composed of a lower melting component and a higher melting component, wherein a substantial proportion of the surfaces of said conjugate fibers comprises said lower melting component, said lower melting component of said conjugate fibers which lie on said first face being fuse bonded to at least one compatible hydrophobic ply of theremoplastic microfine fibers having a fiber diameter of up to 50 microns, said lower melting component of said conjugate fibers having been fuse bonded at a temperature below the melt temperature of said higher melting component of said conjugate fibers so that the latter component retains its initial fiber-like integrity, said material having been treated with a water repellent finish and impregnated with a repellent binder.

2. The material of claim 1, said material being highly compacted and also resistant to delamination, and to steam sterilization.

3. The material of claim 1, in which the ply of hydrophobic microfine fibers comprises ethylene/vinyl acetate copolymer.

4. The material of claim 1, wherein the conjugate fiber is a polyethylene/polyester sheath/core bi-component fiber.

5. The material of claim 1, wherein the conjugate fiber is a polypropylene/polyester sheath/core bi-component fiber.

6. The material of claim 1, in which the ply of hydrophobic microfine fibers is selected from the group consisting of ethylene/vinyl acetate copolymer, polyethylene, chlorinated polyethylene, polyvinyl chloride, and polypropylene.

7. The material of claim 1, wherein the ply of hydrophobic microfine fibers comprises polypropylene.

8. The material of claim 1, comprising two plies of hydrophobic microfine fibers which were initially prepared by melt-blowing, each ply having been extruded from one die only.

9. The material of claim 1, said material having been calendered between smooth heated rolls, direct heat having been applied to both outer surfaces of said material so that said surfaces are regular and the material has good strength properties.

10. The material of claim 1, wherein said material has been bonded by means of smooth heated calenders, said conjugate fibers having been initially oriented.

11. A sterile packaging barrier comprising the material of claim 1, said opposite face of said conjugate fibers being highly printable, said microfine fiber ply being compatible with seal coat systems that are required for heat sealing said ply to a formed polymer blister.

12. The material of claim 1 in which said layer of conjugate fibers is blended with non-conjugate fusible fibers, with the proviso that said first face of said layer of conjugate fibers contains a plurality of conjugate fibers in said blend.

13. A sterile package comprising a polymer blister sealed with the laminated material of claim 1.

14. A sterile package comprising a sealed envelope consisting of the laminated material of claim 1.

15. The material of claim 1 in which said water repellent finish comprises at least about 0.05% by weight of the untreated material.

16. The material of claim 2 in which said water repellent finish comprises between about 0.05% and 5% by weight of the untreated material.

17. The material of claim 2 in which said water repellent finish is selected from the group consisting of wax emulsions, polyurethane emulsions, silicones and fluorochemicals.

18. The material of claim 2, in which said repellent binder comprises at least 1% by weight of the unimpregnated material.

19. The material of claim 2, in which said repellent binder comprises between about 1% and 25% by weight of the unimpregnated material.

20. The material of claim 2, in which said water repellent finish comprises a fluorochemical.

21. The material of claim 2, in which said repellent binder is selected from the group consiting of polybutyl acrylate, styrene-acrylic copolymer, acrylic vinyl chloride copolymer, ethylene-acrylic acid copolymer, ethylene-vinyl acetate copolymer, ethylene-vinyl chloride copolymer, acrylic copolymer latex, styrene-butadiene latex and vinyl chloride latex.

22. The material of claim 21 in which said repellent binder comprises ethylene-acrylic acid copolymer.

23. A water-impervious, smooth-surfaced, gas-permeable, bacterial barrier, laminated material comprising at least one inner hydrophobic microfine fiber ply sandwiched between two layers of conjugate fibers, each of said layers of conjugate fibers having a first face and an opposite face, said conjugate fibers being composed of a lower melting component which is compatible with said microfine fibers, and a higher melting component, wherein a substantial proportion of the surfaces of said fibers coprises said lower melting component, said hydrophobic microfine fibers having a fiber diameter of up to 50 microns, said lower melting components of both layers of said conjugate fibers which lie on said first faces having been fuse bonded to opposite sides of said hydrophobic microfine fiber ply at a temperature below the melt temperature of said higher melting component of said conjugate fibers, so that the latter component retains its initial fiber-like integrity, said material having been treated with a water repellent finish and impregnated with a repellent binder.

24. The material of claim 23, said material having been highly compacted and also resistant to delamination and steam sterilization.

25. The material of claim 23, wherein the ply of hydrophobic microfine fibers is selected from the group consisting of ethylene/vinyl acetate copolymer, polyethylene, polypropylene, chlorinated polyethylene and polyvinyl chloride.

26. A process for preparing a water-impervious, smooth-surfaced, gas-permeable, bacterial barrier, laminated material comprising at least one layer of conjugate fibers, said layer of conjugate fibers having a first face and an opposite face, said conjugate fibers being composed of a lower melting component and a higher melting component, wherein a substantial proportion of the surfaces of said conjugate fibers comprises said lower melting component, said lower melting component of said conjugate fibers which lie on said first face being fuse bonded to at least one hydrophobic ply of microfine fibers having a fiber diameter of up to 50 microns, said lower melting component of said conjugate fibers having been fuse bonded at a temperature below the melt temperature of said higher melting component of said conjugate fibers so that the latter component retains its initial fiber-like integrity, said material being resistant to steam sterilization;

said process comprising forming an assembly of said ply of hydrophobic microfine fibers and at least one layer of said conjugate fibers placed adjacent to said ply of said hydrophobic microfine fibers;

subjecting said assembly to smooth calendering at a temperature sufficient to fuse said lower melting component of said conjugate fibers which lie on said first face as well as the ply of the hydrophobic microfine fibers without fusing the higher melting component of said conjugate fibers, direct heat being applied to both outer surfaces of said assembly so that said surfaces are regular and the resultant material has good strength properties;

cooling said assembly to resolidify said lower melting component of the conjugate fibers as well as said ply of said hydrophobic microfine fibers, whereby said conjugate fibers are firmly bonded to said hydrophobic microfine fiber structure without impairing the integrity of said higher melting component of said fibers and treating said resultant laminated material with a water repellent finish and a repellent binder, or utilizing a layer of conjugate fibers which has been pretreated with a water repellent finish and a repellent binder, before forming said assembly of said ply of microfine fibers and said layer of conjugate fibers.

27. The process of claim 26, in which said assembly is initially formed by passing a prebonded layer of said conjugate fibers beneath a melt blown dye whch deposits said ply of microfine fibers on the surface of said layer of conjugate fibers.

28. The process of claim 26 in which the layer of conjugate fibers is initially unbonded and said ply of microfine fibers is formed separately before being assembled with said layer of conjugate fibers.

29. A process for preparing a water-impervious, smooth-surfaced, gas-permeable, bacterial barrier, lamined material comprising at least one inner ply of hydrophobic microfine fibers sandwiched between two layers of conjugate fibers, each of said layers of conjugate fibers having a first face and an opposite face, said conjugate fibers being composed of a lower melting component and a higher melting component, wherein a substantial proportion of the surfaces of said fibers comprise said lower melting component, said ply of hydrophobic microfine fibers having a fiber diameter of up to 50 microns, said lower melting components of both layers of said conjugate fibers which lie on said first faces having been fuse bonded to said ply of hydrophobic microfine fibers at a temperature below the melt temperature of said higher melting component of said conjugate fibers, so that the latter component retains its initial fiber-like integrity, said material being resistant to steam sterilization;

said process comprising forming an assembly of said ply of hydrophobic microfine fibers sandwiched between two layers of said conjugate fibers, subjecting said assembly to smooth calendering at a temperature sufficient to fuse said lower melting components of said conjugate fibers which lie on said first faces in both of said layers thereof as well as said ply of said hydrophobic microfine fibers without fusing the higher melting components of said conjugate fibers, direct heat being applied to both outer surfaces of said assembly so that said surfaces are regular and the resultant material has good strength properties;

cooling said assembly to resolidify said lower melting components of the fibers as well as said ply of hydrophobic microfine fibers, whereby said fibers are firmly bonded to said hydrophobic microfine fibers without impairing the integrity of said higher melting component of said fibers, and treating said resultant laminated material with a water repellent finish and a repellent binder, or utilizing layers of conjugate fibers which have been pretreated with a repellent before forming said assembly of said ply of microfine fibers and said two layers of conjugate fibers.

* * * * *

UNITED STATES PATENT AND TRADEMARK OFFICE

CERTIFICATE OF CORRECTION

PATENT NO. : 4,657,804

DATED : April 14, 1987

INVENTOR(S) : Alfred T. Mays et al.

It is certified that error appears in the above-identified patent and that said Letters Patent is hereby corrected as shown below:

Column 14, line 46
"repellent before forming"

should read

--water repellent finish and a repellent binder before forming--

Signed and Sealed this

Twenty-fifth Day of August, 1987

*Attest:*

DONALD J. QUIGG

*Attesting Officer*

*Commissioner of Patents and Trademarks*